US011230999B2

(12) United States Patent
Itami

(10) Patent No.: US 11,230,999 B2
(45) Date of Patent: Jan. 25, 2022

(54) FUEL INJECTION DEVICE

(71) Applicant: DENSO CORPORATION, Kariya (JP)

(72) Inventor: Shoichi Itami, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/902,597

(22) Filed: Jun. 16, 2020

(65) Prior Publication Data

US 2020/0400111 A1 Dec. 24, 2020

(30) Foreign Application Priority Data

Jun. 19, 2019 (JP) ..... JP2019-113848

(51) Int. Cl.

| | |
|---|---|
| ***F01N 3/023*** | (2006.01) |
| ***F01N 3/029*** | (2006.01) |
| ***F02M 53/04*** | (2006.01) |
| ***F02M 61/16*** | (2006.01) |
| ***F02M 51/00*** | (2006.01) |
| *F02M 51/06* | (2006.01) |

(52) U.S. Cl.

CPC ..... *F02M 53/043* (2013.01); *F01N 3/0234* (2013.01); *F01N 3/0293* (2013.01); *F02M 51/005* (2013.01); *F02M 53/046* (2013.01); *F02M 61/166* (2013.01); *F01N 2260/024* (2013.01); *F01N 2610/11* (2013.01); *F02M 51/061* (2013.01)

(58) Field of Classification Search

CPC .. F02M 53/043; F02M 53/046; F02M 61/166; F01N 3/0234; F01N 3/0293; F01N 2260/024; F01N 2610/02; F01N 2610/11

USPC ..... 123/41.31, 541; 239/132.3, 585; 60/295, 60/298

See application file for complete search history.

(56) References Cited

U.S. PATENT DOCUMENTS

| | | | | |
|---|---|---|---|---|
| 7,849,836 | B2 * | 12/2010 | Chang | F02M 47/027 123/456 |
| 7,895,829 | B2 * | 3/2011 | Suzuki | F01N 3/2066 60/286 |
| 2007/0044767 | A1 * | 3/2007 | Kojima | F02M 63/0225 123/470 |
| 2010/0176223 | A1 * | 7/2010 | Venkataraghavan | F02M 53/04 239/585.1 |
| 2011/0192140 | A1 * | 8/2011 | Olivier | F01N 3/2066 60/274 |
| 2014/0116032 | A1 * | 5/2014 | Yetkin | F01N 3/2066 60/295 |
| 2017/0363053 | A1 * | 12/2017 | Ichihashi | F02M 53/04 |
| 2018/0320573 | A1 | 11/2018 | Thoemmes | |
| 2019/0390994 | A1 * | 12/2019 | Kwun | F04D 15/0088 |

FOREIGN PATENT DOCUMENTS

DE 102015221160 5/2017

* cited by examiner

*Primary Examiner* — Erick R Solis
(74) *Attorney, Agent, or Firm* — Nixon & Vanderhye P.C.

(57) ABSTRACT

An injector includes a nozzle portion to inject fluid, a coil to generate a driving force to open and close the nozzle portion, and a molded resin that seals the coil. A cooling jacket has a flow path to cause cooling fluid to flow therethrough. The cooling jacket houses the injector and has an opening in an end opposite to the nozzle portion. A sealing material is filled in a space between the cooling jacket and the molded resin.

9 Claims, 9 Drawing Sheets

FUEL INJECTION DEVICE

CROSS REFERENCE TO RELATED APPLICATION

The present application claims the benefit of priority from Japanese Patent Application No. 2019-113848 filed on Jun. 19, 2019. The entire disclosures of all of the above applications are incorporated herein by reference.

TECHNICAL FIELD

The present disclosure relates to a fuel injection device.

BACKGROUND

Conventionally, a known fluid injection device is used in an internal combustion engine system.

SUMMARY

According to an aspect of the present disclosure, a fluid injection device includes an injector and a cooling jacket.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1:
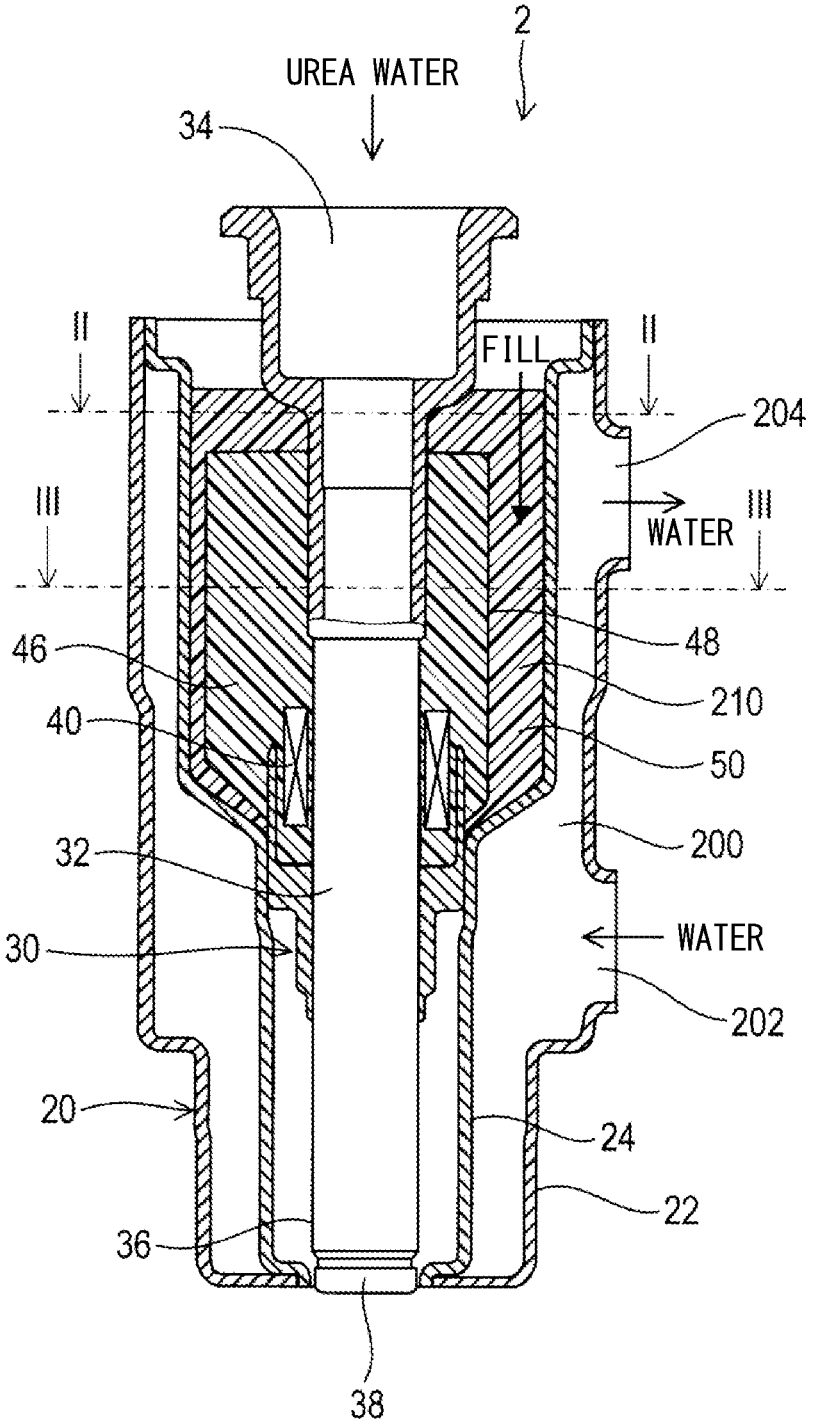
FIG. 1 is a cross-sectional view showing a fluid injection device according to a first embodiment.

Hereinbelow, examples of the present disclosure will be described.

According to an example of the present disclosure, an injector is used in a high-temperature environment. The injector is housed inside a cooling jacket and is cooled with a cooling fluid flowing through the cooling jacket. According to an example of the present disclosure, a fluid injection device is configured to inject a reducing agent from an injector into an exhaust pipe of an engine. In this example, the fluid injection device includes the injector and a housing. The housing houses the injector and further serves as a cooling jacket that enables a cooling fluid to flow therethrough for cooling the injector.

In an example of the present disclosure, the housing includes: a pot-shaped main body that houses the injector; a cover that closes an opening of the main body to restrict foreign matter from entering the inside of the main body; and an internal housing that enables a cooling fluid to flow. Further, in this example, the cover supports a pipe, which is for supplying a reducing agent to the injector, and a socket, which is for taking out a harness to be electrically connected to an electric terminal of the injector.

It is noted that, the inventor found out, as a result of detailed studies, an issue of the above examples. Specifically, in the examples, the number of components of a fluid injection device may increase in order to embody various functions to close the opening of the housing, to support the socket and the pipe to enable the harness to be taken out of the injector to the outside, and further to enable a cooling fluid to flow therethrough. In the case where the number of components increases, the fluid injection device may become large in size.

According to another example of the present disclosure, a fluid injection device comprises an injector that includes: a nozzle portion configured to inject fluid; a coil configured to generate a driving force to drive the nozzle portion to open and close the nozzle portion; and a molded resin that seals the coil.

The fluid injection device further comprises a cooling jacket that has a flow path configured to cause cooling fluid to flow therethrough, that houses the injector, and that has an opening in an end opposite to the nozzle portion. The fluid injection device further comprises a sealing material that is filled in a space between the cooling jacket and the molded resin.

According to this configuration, the injector is supported by the sealing material filled in the space between the cooling jacket and the molded resin. Furthermore, even a configuration in which the opening at the end of the cooling jacket opposite to the nozzle is not enclosed with a cover but is open, the components of the injector encapsulated with the sealing material can be protected from exposure to the environment on the opening side of the cooling jacket.

In this way, the sealing member may have various functions required for the fluid injection device. Therefore, the number of components of the fluid injection device may be reduced. Thus, the configuration may enable to downsize the fluid injection device.

Hereinbelow, embodiments of the present disclosure will be described with reference to the drawings.

1. First Embodiment

1-1. Configuration

A fluid injection device 2 shown in FIG. 1 includes a cooling jacket 20, an injector 30, and a sealing material 50. The fluid injection device 2 is installed, for example, upstream of an SCR catalyst in an exhaust pipe of an internal combustion engine to inject ammonia as a reducing agent into an exhaust passage upstream of the SCR catalyst. SCR is an abbreviation of selective catalytic reduction.

The cooling jacket 20 includes a tubular outer jacket 22 and a tubular inner jacket 24 that is smaller in diameter than the outer jacket 22. A space between the outer jacket 22 and the inner jacket 24 forms a flow path 200 that is ring-shaped in cross section for causing cooling water as a cooling fluid to flow therethrough.

The outer jacket 22 has a cooling water inlet 202 and a cooling water outlet 204. The cooling water inlet 202 is formed on one end side of the outer jacket 22 in the axial direction that is on the side of a nozzle portion 36 of the injector 30. The cooling water outlet 204 is formed on the other end side of the outer jacket 22 opposite to the nozzle portion 36. The cooling jacket 20 has an opening at the end opposite to the nozzle portion 36 of the injector 30.

A cooling water supplied to the cooling water inlet 202 is fed through the flow path 200 and is discharged from the cooling water outlet 204. The injector 30 housed on the radially inside of the inner jacket 24 is cooled with the cooling water flowing through the flow path 200.

The injector 30 includes a valve body 32, the nozzle portion 36, a coil 40, harnesses 42 to be described later, and a molded resin 46. One end of the valve body 32 has an inflow port 34 to which urea water is supplied. The other end of the valve body 32 is equipped with an injection hole plate 38 of the nozzle portion 36 by welding or the like.

The injection hole plate 38 has an injection hole for injecting a urea water that flows from the inflow port 34. A nozzle needle (not shown) of the nozzle portion 36 moves back and forth thereby to open and close nozzle holes of the injection hole plate 38.

Figure 2:
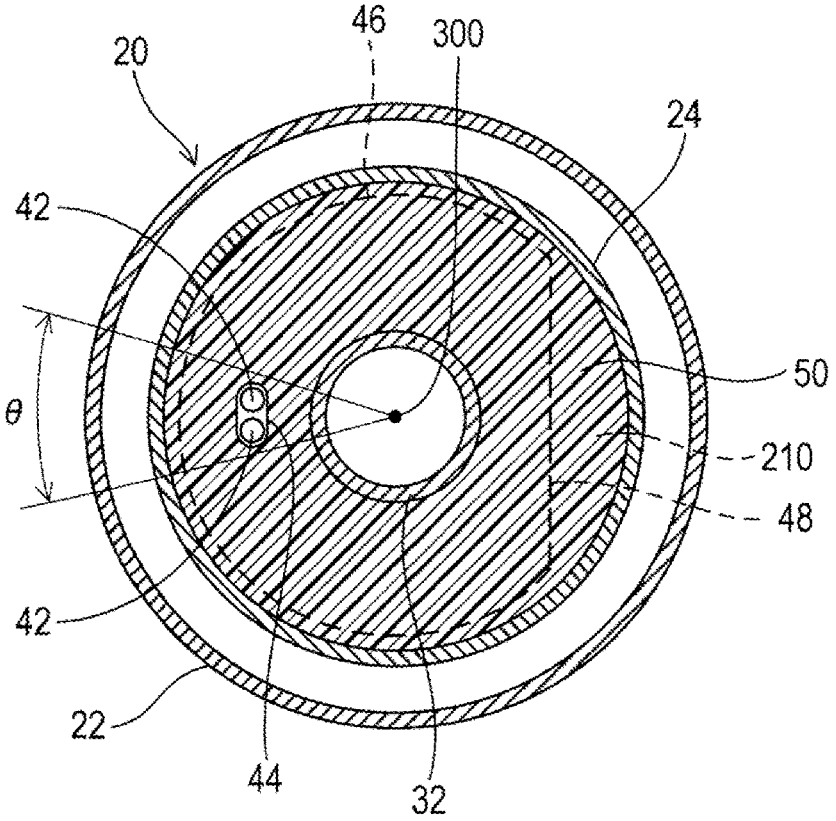
FIG. 2 is a sectional view taken along a line II-II in FIG. 1.
Figure 3:
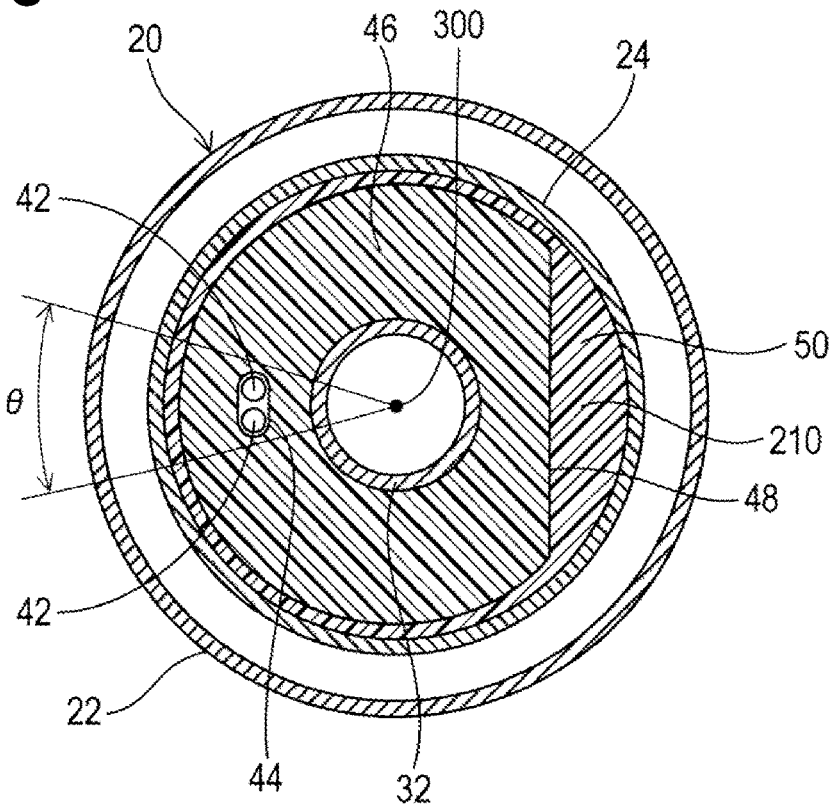
FIG. 3 is a sectional view taken along a line III-Ill in FIG. 1.

The coil 40 is an electromagnetic drive unit that generates a driving force to drive the nozzle needle to move back and forth thereby to open and close the nozzle holes. The harnesses 42 shown in FIGS. 2 and 3 are to supply electric power to the coil 40. The two harnesses 42 are supported by a support member 44 and are taken out of the molded resin 46. Note that the harnesses 42 is not shown in the sectional view of FIG. 1.

The molded resin 46 covers the periphery of the coil 40 to seal the coil 40 and to fix the coil 40. As shown in FIGS. 1 to 3, the outer peripheral surface of the molded resin 46 has a flat portion 48 partially in the circumferential direction. The flat portion 48 is recessed from the periphery toward the axial center and extends in the axial direction. The flat portion 48 may be formed outside an angular range θ in the circumferential direction about a center axis 300 of the injector 30 to include the two harnesses 42. For example, the angle range θ is 25°. In the first embodiment, the flat portion 48 is formed on the opposite side of the two harnesses 42 in the radial direction.

The sealing material 50 is filled into a space between the inner jacket 24 and the molded resin 46 through an opening of the cooling jacket 20. The opening of the cooling jacket 20 is formed in the end of the cooling jacket 20 opposite to the nozzle portion 36 of the injector 30. The sealing material 50 covers the molded resin 46 and supports the injector 30. As described above, the opening in the end of the cooling jacket 20, which is opposite to the nozzle portion 36 of the injector 30, is open. Therefore, the sealing material 50 is exposed to the environment on the side of the opening of the cooling jacket 20.

The sealing material 50 is a compound formed by mixing metal powder or metal oxide powder, which is high in thermal conductivity, into a resin material, which has a thermosetting property and flexibility. The resin, which has a thermosetting property and flexibility is, for example, urethane resin, silicon resin, epoxy resin, or the like. The metal powder or metal oxide powder, which is high in thermal conductivity is, for example, alumina.

The sealing material 50 is filled at a position above the space between the flat portion 48 and the inner jacket 24 into the space. Herein, as described above, the flat portion 48 is recessed toward the center relative to the remaining portion of the molded resin 46 in the circumferential direction. Therefore, the distance between the flat portion 48 and the inner peripheral surface of the inner jacket 24 in the radial direction is larger than the distance between the outer peripheral surface of the remaining portion of the molded resin 46 other than the flat portion 48 in the circumferential direction and the inner peripheral surface of the inner jacket 24.

That is, the space between the flat portion 48 and the inner jacket 24 forms an enlarged portion 210 in which the distance in the radial direction is larger than the distance in the radial direction in the other space. Therefore, a flow path resistance, which is a resistance against fluid flow, in the space between the flat portion 48 and the inner jacket 24 is smaller than the flow path resistance in the space between the outer peripheral surface of the remaining portion of the molded resin 46, which is other than the flat portion 48, and the inner jacket 24.

Fluid flows more easily in a space in which the flow path resistance is small compared with a space in which the flow path resistance is large. Therefore, the sealing material 50, which is filled from the filling position above the enlarged portion 210 directly reaches the bottom of the space between the flat portion 48 and the inner jacket 24 underneath the filling position more fast than reaching the space on the radially opposite side of the filling position after flowing along the circumferential direction. Subsequently, the sealing material 50 that has flowed into the space between the flat portion 48 and the inner jacket 24 further flows into the remaining space in the circumferential direction and upward from the underneath.

1-2. Effect

The first embodiment described above produces the following effects.

(1a) The flow path resistance in the space between the flat portion 48 and the inner jacket 24 is smaller than the flow path resistance in the other remaining space. Therefore, the sealing material 50 reaches the bottom portion faster than the other remaining space, without trapping air bubbles in the space between the flat portion 48 and the inner jacket 24.

The sealing material 50 flowing into the space between the flat portion 48 and the inner jacket 24 flows upward from the bottom to push up air in the other remaining space before the sealing material 50 flowing in the circumferential direction encapsulates the upper portion of the other remaining space. In this way, the sealing material 50 excludes air from the space between the molded resin 46 and the inner jacket 24, thereby to enable to restrict air bubbles from being trapped in the sealing material 50 that is filled.

(1b) The sealing material 50 filled in the space between the cooling jacket 20 and the molded resin 46 supports the injector 30. Furthermore, the sealing material 50 covers at least the molded resin 46. Therefore, even in the configuration where the opening in the end of the cooling jacket 20 on the opposite side to the nozzle portion 36 is open, the sealing material 50 enables to protect the injector 30, which is embedded with the sealing material 50, from exposure to the environment on the side of the opening of the cooling jacket 20.

As described above, the sealing material 50 produces various functions required for the fluid injection device 2. Therefore, the number of components of the fluid injection device 2 can be reduced as much as possible. In this way, the configuration enables to downsize the fluid injection device 2.

(1c) The resin material of the sealing material 50 has a thermosetting property and flexibility. Therefore, even in a case where the sealing material 50 repeats expansion and contraction due to change in the surrounding temperature, the sealing material 50 enables to adapt to the expansion and contraction without damage such as cracking while maintaining its hardness in a high-temperature environment.

(1d) The resin material of the sealing material 50 is mixed with metal powder or metal oxide powder that has high thermal conductivity. Therefore, the injector 30 can be efficiently cooled by the cooling water flowing through the cooling jacket 20.

2. Second Embodiment

2-1. Difference from First Embodiment

The fundamental configuration of the second embodiment is similar to that of the first embodiment. Therefore, the difference therebetween will be described below. The same reference numerals as in the first embodiment denote the same components, and reference is made to the preceding description.

In the fluid injection device 2 of the first embodiment described above, the flat portion 48 is formed in the part of the molded resin 46 in the circumferential direction. In this way, the first embodiment enables to reduce the flow path resistance in the space between the flat portion 48 and the inner jacket 24 in the space compared with the flow path resistance in the other remaining space. The first embodiment, in this way, raises the difference in flow path resistance in the space filled with the sealing material 50.

Figure 4:
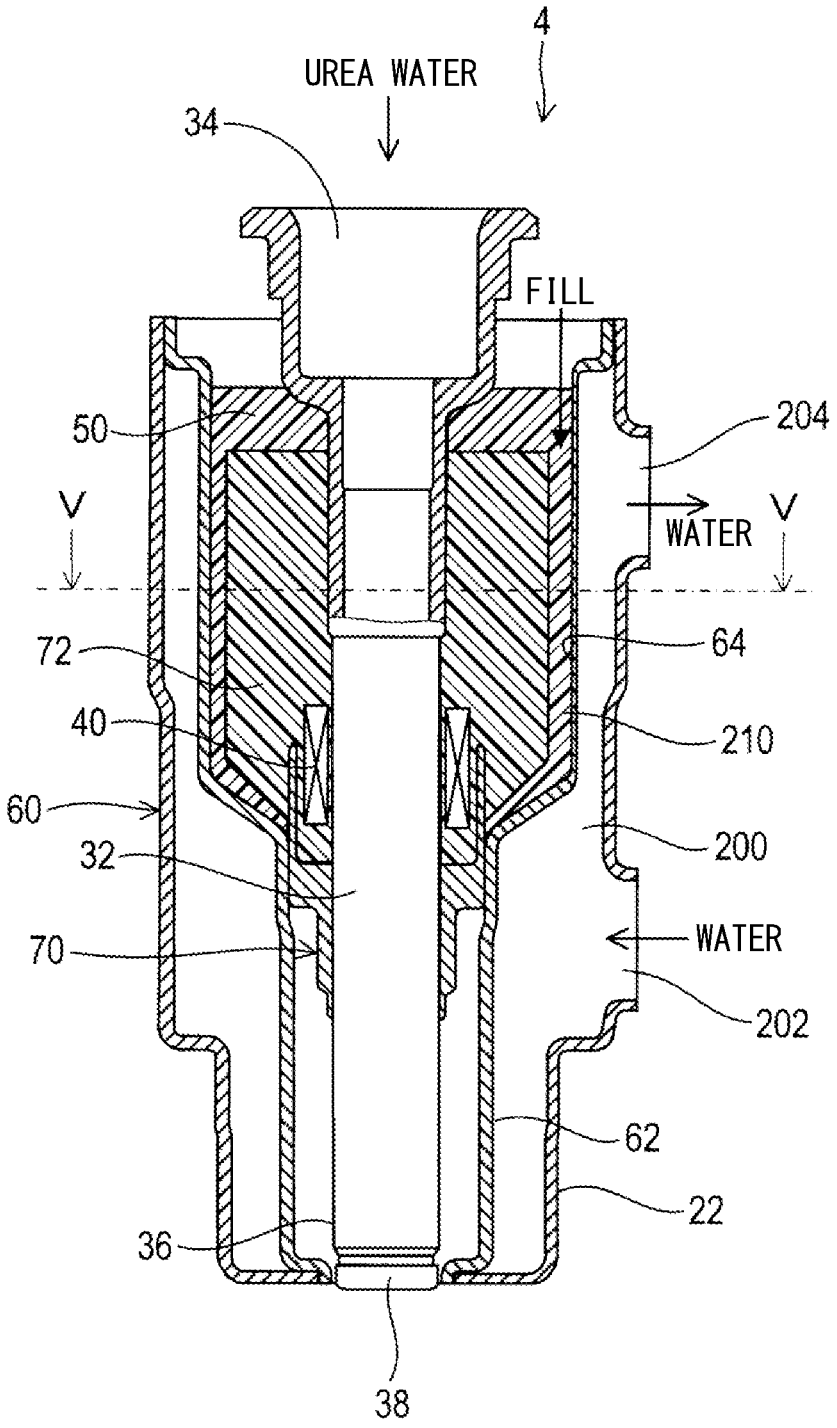
FIG. 4 is a sectional view showing a fluid injection device according to a second embodiment.
Figure 5:
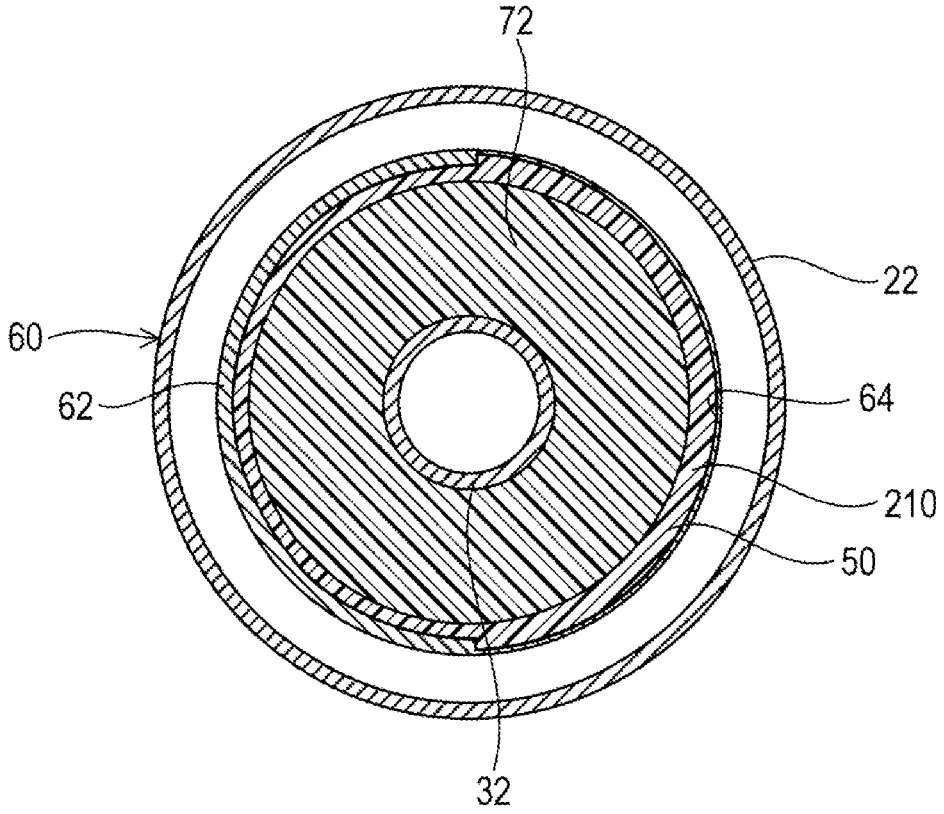
FIG. 5 is a sectional view taken along a line V-V in FIG. 4.

To the contrary, in a fluid injection device 4 according to the second embodiment shown in FIGS. 4 and 5, an inner jacket 62 of a cooling jacket 60 has a recess portion 64 partially in the circumferential direction. The inner peripheral surface of the inner jacket 62 is dented in the recess portion 64 outward in the radial direction. In an injector 70 of the second embodiment, the outer diameter of a molded resin 72 is constant. It is noted that, in FIG. 15, illustration of harnesses 42 is omitted.

The second embodiment is different from the first embodiment in this configuration, in which the distance in the radial direction between the recess portion 64 of the inner jacket 62 and the molded resin 72 in a predetermined region in the circumferential direction is larger than the distance in the radial direction between the portion of the inner jacket 62 other than the recess portion 64 and the molded resin 72 in a predetermined region in the circumferential direction.

In the second embodiment, the enlarged portion 210 is formed in which the distance in the radial direction between the recess portion 64 of the inner jacket 62 and the molded resin 72 in the predetermined region in the circumferential direction is larger than the distance in the radial direction between the portion of the inner jacket 62 other than the recess portion 64 and the molded resin 72 in the predetermined region in the circumferential direction.

In this configuration of the second embodiment, the flow path resistance in the space between the recess portion 64 and the molded resin 72 is smaller than the flow path resistance in the space between the portion of the inner jacket 62 other than the recess portion 64 and the molded resin 72.

2-2. Effects

The second embodiment described above produces the following effects in addition to the effects (1b) to (1d) of the first embodiment described above.

(2a) The flow path resistance in the space between the recess portion 64 and the molded resin 72 is smaller than the flow path resistance in the space formed between the portion of the inner jacket 62 other than the recess portion 64 and the molded resin 72. Therefore, the space between the recess portion 64 and the molded resin 72 is filled with the sealing material 50 to the bottom faster than the other space without trapping air bubbles therein.

The sealing material 50 that has flowed into the space between the recess portion 64 and the molded resin 72 flows upward from the bottom to push air in the other space upward before the upper portion of the other space is encapsulated with the sealing material 50 that flows in the circumferential direction. In this way, the sealing material 50 excludes air from the space between the molded resin 46 and the inner jacket 62, thereby to enable to restrict air bubbles from being trapped in the sealing material 50 that is filled.

3. Third Embodiment

3-1. Difference from Second Embodiment

The fundamental configuration of the third embodiment is similar to that of the second embodiment. Therefore, the difference therebetween will be described below. The same reference numerals as in the first and second embodiments denote the same components, and reference is made to the preceding description.

In the fluid injection device 4 of the second embodiment described above, the recess portion 64 is formed in the part of the inner jacket 62 of the cooling jacket 60 in which the inner circumferential surface is dented outward in the radial direction in the predetermined region in the circumferential direction. In this way, the second embodiment reduces the flow path resistance in the space between the recess portion 64 and the molded resin 72 compared with the flow path resistance in the space between the portion of the inner jacket 62 other than the recess portion 64 and the molded resin 72.

Figure 6:
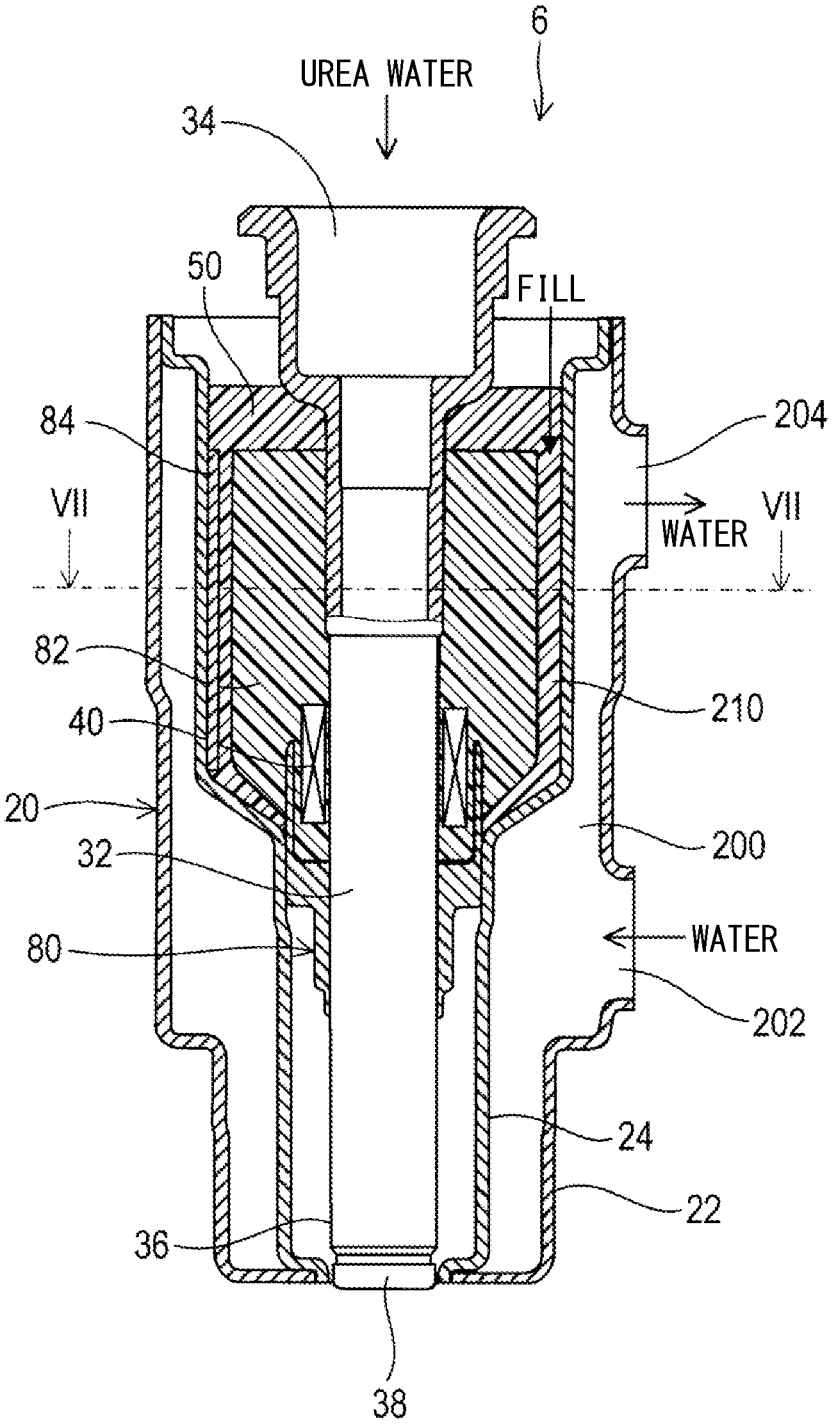
FIG. 6 is a sectional view showing a fluid injection device according to a third embodiment.
Figure 7:
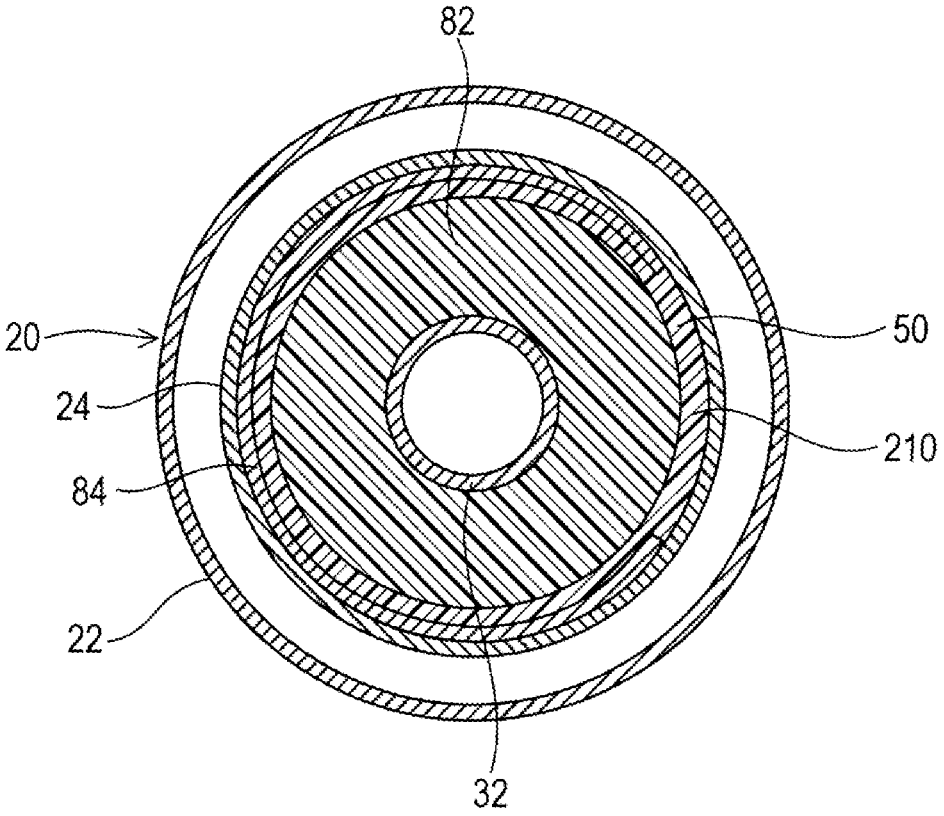
FIG. 7 is a sectional view taken along a line VII-VII of FIG. 6.

To the contrary, in a fluid injection device 6 of the third embodiment shown in FIGS. 6 and 7, a resistance adjusting member 84 having a C-shaped cross section is resiliently fitted to the inner peripheral surface of the inner jacket 24. The resistance adjusting member 84 may be formed of metal or resin. The resistance adjusting member 84 is a part of the inner jacket 24 and forms an inner peripheral surface of the inner jacket 24. The outer diameter of a molded resin 82 of an injector 80 is constant. In FIG. 7, illustration of the harnesses 42 is omitted.

In this configuration of the third embodiment, the space between the portion of the inner jacket 24, in which the resistance adjusting member 84 does not reside, and the molded resin 82 is larger than the space between the resistance adjusting member 84 and the molded resin 82. The third embodiment is different from the second embodiment in this configuration in which the flow path resistance in the space between the portion of the inner jacket 24, in which the resistance adjusting member 84 does not reside, and the molded resin 82 is smaller than the flow path resistance in the space between the resistance adjusting member 84 and the molded resin 82.

The third embodiment forms the enlarged portion 210, in which the space between the portion of the inner jacket 24, in which the resistance adjusting member 84 does not reside, and the molded resin 82 is larger than the space between the resistance adjusting member 84 and the molded resin 82.

3-2. Effect

The third embodiment described above produces the following effects in addition to the effects (1b) to (1d) of the first embodiment described above.

(3a) The flow path resistance in the space between the portion of the inner jacket 24, in which the resistance adjusting member 84 does not arise, and the molded resin 82 is smaller than the flow path resistance in the space between the resistance adjusting member 84 and the molded resin 82. Therefore, the space between the portion of the inner jacket 24, in which the resistance adjusting member 84 does not arise, and the molded resin 82 is filled with the sealing material 50 to the bottom faster than the other remaining space without trapping air bubbles therein.

The sealing material 50 that has flowed into the space between the portion of the inner jacket 24, in which the resistance adjusting member 84 does not arise, and the molded resin 82 flows upward from the bottom to push up air in the other remaining space before the upper portion of the other remaining space is encapsulated with the sealing material 50 flowing in the circumferential direction. In this way, air is extruded from the space between the molded resin 82 and the inner jacket 24 and from the space between the molded resin 82 and the resistance adjusting member 84, thereby to restrict air bubbles from being trapped in the sealing material 50 that is filled.

4. Fourth Embodiment 4-1. Difference from First Embodiment

The fundamental configuration of the fourth embodiment is similar to that of the first embodiment. Therefore, the difference therebetween will be described below. The same reference numerals as in the first embodiment denote the same components, and reference is made to the preceding description.

The fluid injection device 2 of the first embodiment described above raises the difference in the flow path resistance in the space between the molded resin 46 and the inner jacket 24, thereby to enable to fill the sealing material 50 faster to the bottom of the space where the flow path resistance is smaller than the other remaining space.

Figure 8:
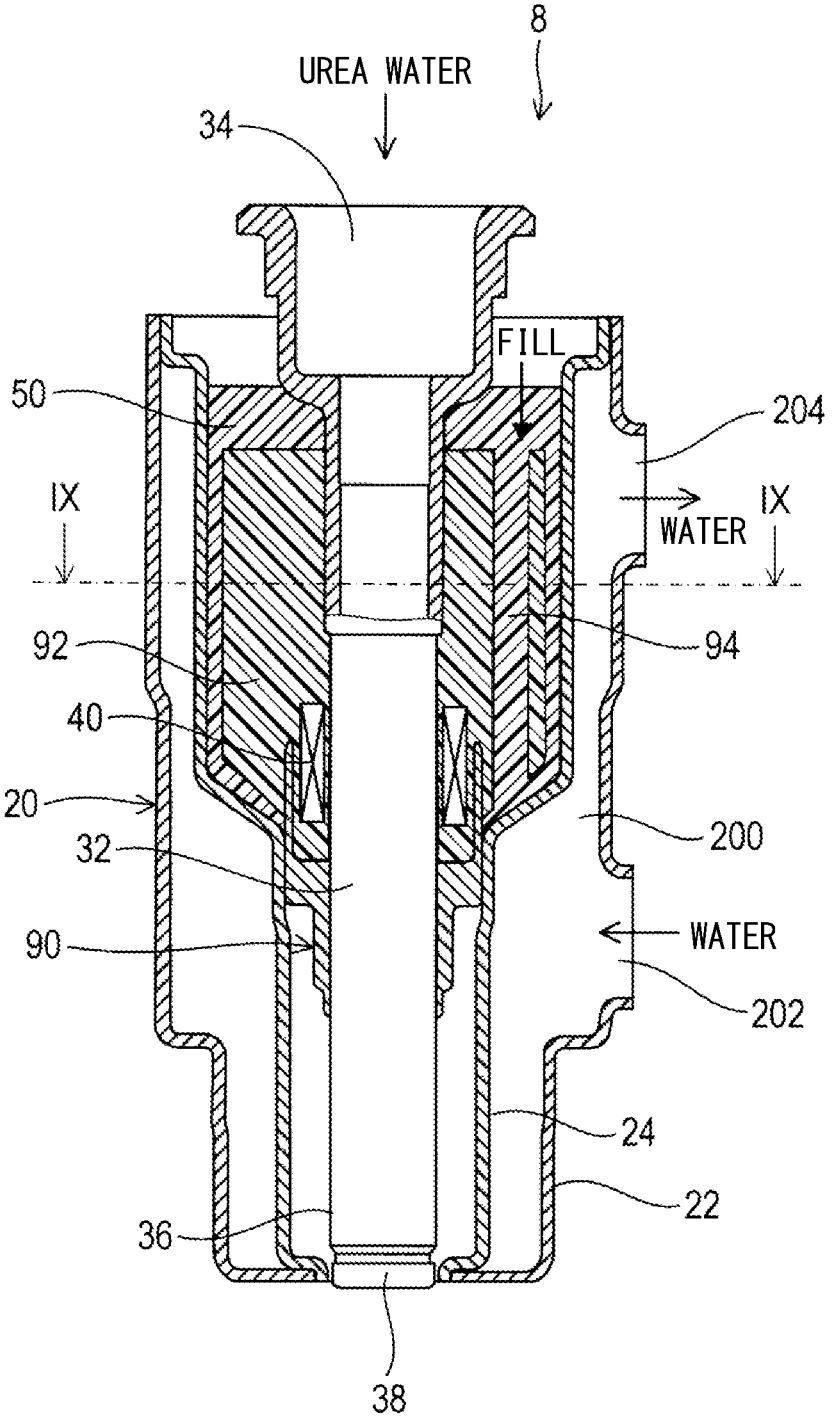
FIG. 8 is a sectional view showing a fluid injection device according to a fourth embodiment.
Figure 9:
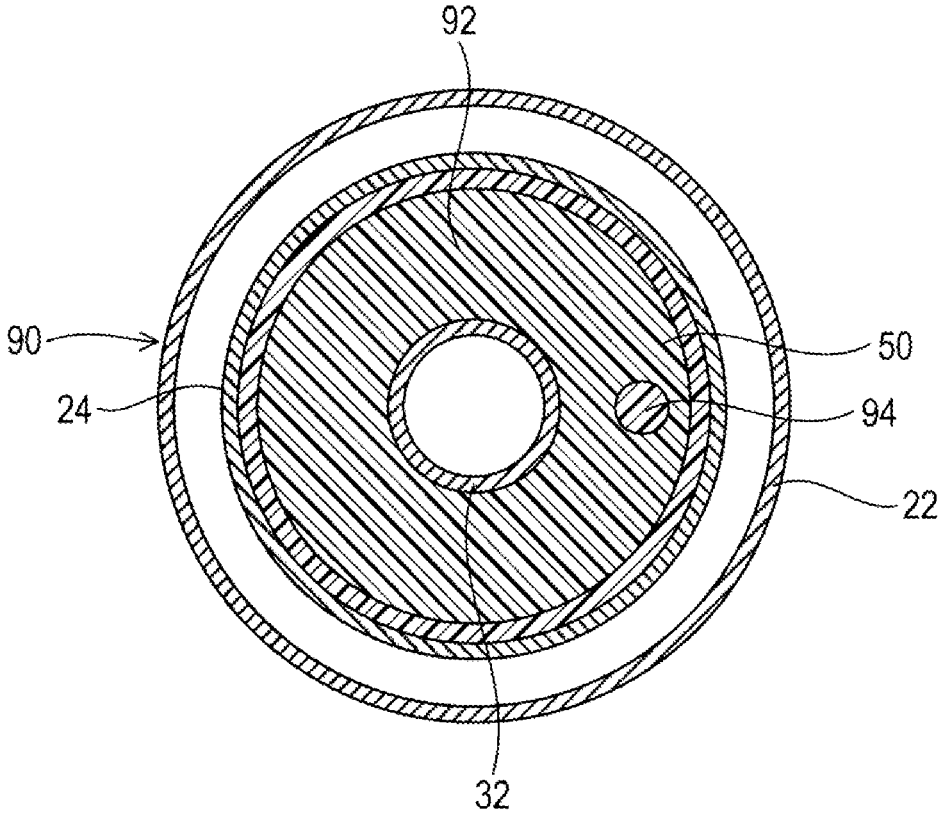
FIG. 9 is a sectional view taken along a line IX-IX in FIG. 8.

To the contrary, in a fluid injection device 8 of the fourth embodiment shown in FIGS. 8 and 9, the outer diameter of a molded resin 92 of an injector 90 is constant. Therefore, the fourth embodiment differs from the first embodiment in that the flow path resistance of the space between the molded resin 92 and the inner jacket 24 is constant. In FIG. 7, illustration of the harnesses 42 is omitted.

It is noted that, in the fourth embodiment, a through hole 94 that penetrates the molded resin 92 in the axial direction is formed at least at one position in the circumferential direction of the molded resin 92. At the circumferential position where the through hole 94 is formed, the sealing material 50 flows into the bottom of the inner jacket 24 through the through hole 94 in addition to the space between the molded resin 92 and the inner jacket 24.

Therefore, at the circumferential position where the through hole 94 is formed, the sealing material 50 flows to the bottom of the inner jacket 24 faster than at the other remaining circumferential positions.

4-2. Effect

The fourth embodiment described above produces the following effects in addition to the effects (1b) to (1d) of the first embodiment described above.

(4a) At the circumferential position where the through hole 94 is formed, the sealing material 50 flows into the bottom of the inner jacket 24 faster than at the other remaining circumferential positions, and therefore, the bottom is filled with the sealing material 50, without trapping and sealing air bubbles.

The sealing material 50 that has flowed to the bottom at the circumferential position where the through hole 94 is formed flows upward from the bottom to push up air in the other remaining space before the upper portion in the other remaining space is encapsulated with the sealing material 50 that flows in the circumferential direction. In this way, the sealing material 50 excludes air from the space between the molded resin 92 and the inner jacket 24, thereby to enable to restrict air bubbles from being trapped in the sealing material 50 that is filled.

5. Fifth Embodiment 5-1. Difference from Fourth Embodiment

The fundamental configuration of the fifth embodiment is similar to that of the fourth embodiment. Therefore, the difference therebetween will be described below. The same reference numerals as in the fourth embodiment denote the same components, and reference is made to the preceding description.

Figure 10:
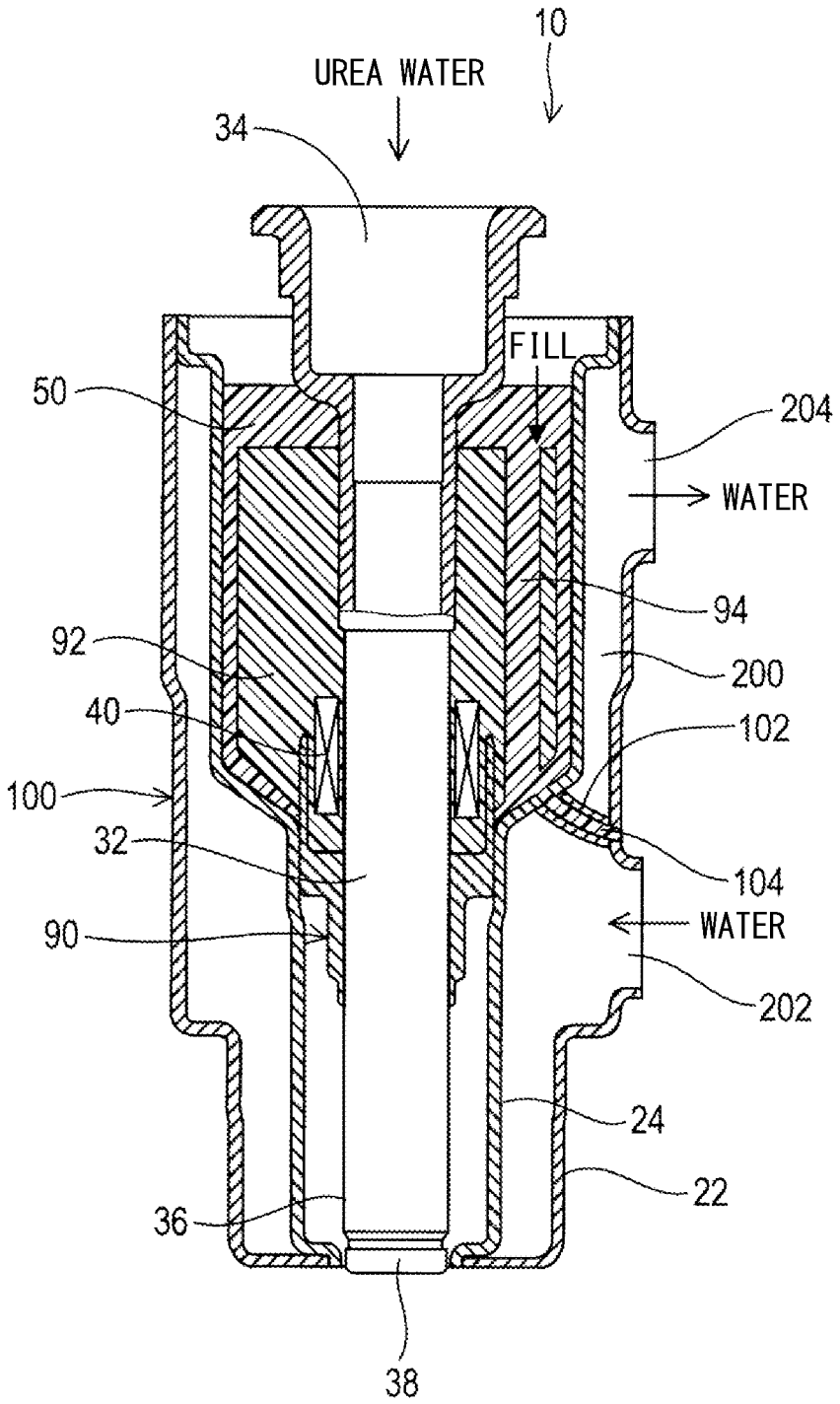
FIG. 10 is a sectional view showing a fluid injection device according to a fifth embodiment.

A fluid injection device 10 according to the fifth embodiment shown in FIG. 10 is the same as the fluid injection device 8 of the fourth embodiment in that the through hole 94 that penetrates the molded resin 92 in the axial direction is formed at least at the one position in the circumferential direction of the molded resin 92 of the injector 90.

In the fifth embodiment, a cooling jacket 100 further includes a connection pipe 102 at the same circumferential position as the through hole 94. The connection pipe 102 connects the outer jacket 22 with the inner jacket 24. The connection pipe 102 forms a communication flow path 104 at a position corresponding to the bottom of the space between the molded resin 92 and the inner jacket 24. The communication flow path 104 forms the communication flow path 104 that communicates the space on the radially inner side of the inner jacket 24 with the space on the radially outer side of the outer jacket 22. More specifically, the communication flow path 104 may be formed at the position corresponding to the filling position in the circumferential direction and/or the radial direction.

This configuration enables air that is pushed by the sealing material 50 flowing into the bottom of the inner jacket 24 through the through hole 94 is discharged to the outside of the outer jacket 22 through the connection pipe 102.

5-2. Effect

The fifth embodiment described above enables to produce the following effects in addition to the effects (1b) to (1d) of the first embodiment and the effect (4a) of the fourth embodiment.

(5a) The air pushed by the sealing material 50 flowing into the bottom of the inner jacket 24 through the through hole 94 is discharged to the outside of the outer jacket 22 through the connection pipe 102, such that air is discharged to the outside of the inner jacket 24. In this way, this configuration enables to fill the sealing material 50 in the bottom of the inner jacket 24 without trapping air bubbles.

6. Other Embodiments

Although the embodiments of the present disclosure have been described above, the present disclosure is not limited to the embodiments described above, and various modifications can be made to implement the present disclosure.

(6a) In the above embodiment, the description has been given of the device that injects urea water into the exhaust passage of the internal combustion engine at the position upstream of the SCR catalyst as the fluid injection device that cools the injector with the cooling water flowing through the cooling jacket. The fluid sprayed with the injector is not limited to urea water. For example, the injector may inject fuel into an exhaust passage upstream of a DOC. DOC is an abbreviation for a diesel oxygen catalyst.

(6b) The fluid injection device is not limited to being used in an internal combustion engine and may be used in various fields as long as the fluid injection device is used in a high-temperature environment to cool an injector with a cooling fluid flowing through a cooling jacket.

(6c) The first embodiment and the second embodiment may be combined. Specifically, the recess portion 64 may be formed in the inner jacket 62 in the predetermined region in the circumferential direction that faces the flat portion 48 of the molded resin 46.

(6d) In the first embodiment, the inner jacket 24 and the outer jacket 22 at the bottom of the enlarged portion 210 may be communicated through the connection pipe 102 described in the fourth embodiment.

(6e) The distance in the radial direction between the molded resin and the inner jacket may be constant in the entirety of the circumference in a configuration in which the end of the cooling jacket is open on the opposite side to the nozzle and in which the sealing material 50 filled in the radially inner side of the cooling jacket covers the outer periphery of the molded resin is exposed to the space on the opening side of the cooling jacket. The distance in the radial direction between the molded resin and the inner jacket may be constant in the entirety of the circumference direction. Further, the through-hole to cause the sealing material to flow need not be formed in the molded resin.

(6f) The cooling fluid flowing through the flow path of the cooling jacket may be a fluid other than water. For example, the cooling fluid may be air.

(6g) The multiple functions of one component in the above embodiment may be realized by multiple components, or a function of one component may be realized by the multiple components. A plurality of functions of a plurality of elements may be implemented by one element, or one function implemented by a plurality of elements may be implemented by one element. In addition, a part of the configuration of the described above embodiment may be omitted. At least a part of the configuration of the described above embodiment may be added to or replaced with another configuration of the described above embodiment.

The harnesses 42 may be one or may be three or more.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fluid injection device comprising:
an injector that includes:
a nozzle portion configured to inject fluid;
a coil configured to generate a driving force to drive the nozzle portion to open and close the nozzle portion; and
a molded resin that seals the coil;
a cooling jacket that has a flow path configured to cause cooling fluid to flow therethrough, that houses the injector, and that has an opening in an end opposite to the nozzle portion; and
a sealing material that is filled in a space between the cooling jacket and the molded resin, wherein
the sealing material covers an end of the molded resin opposite to the nozzle portion, and
the sealing material is exposed to the opening.

2. The fluid injection device according to claim 1, wherein
the space between the cooling jacket and the molded resin, and in which the sealing material is filled, includes an enlarged portion partially in the circumferential direction, and
a distance between the cooling jacket and the molded resin is larger in the enlarged portion than in an other portion that is other than the enlarged portion.

3. The fluid injection device according to claim 2, further comprising:
a harness that is electrically connected to the coil, wherein
the enlarged portion is formed outside an angular range of 25° about a center axis of the injector in a circumferential direction, and
the harness resides in the angular range.

4. A fluid injection device comprising:
an injector that includes:
a nozzle portion configured to inject fluid;
a coil configured to generate a driving force to drive the nozzle portion to open and close the nozzle portion; and
a molded resin that seals the coil;
a cooling jacket that has a flow path configured to cause cooling fluid to flow therethrough, that houses the injector, and that has an opening in an end opposite to the nozzle portion; and
a sealing material that is filled in a space between the cooling jacket and the molded resin, wherein
the sealing material is formed of a resin material that is mixed with a material higher in thermal conductivity than the resin material.

5. The fluid injection device according to claim 1, wherein
the sealing material is formed of a resin material, and
the resin material has a thermosetting property and flexibility.

6. The fluid injection device according to claim 1, wherein
the molded resin has a through hole that extends through the molded resin in an axial direction.

7. The fluid injection device according to claim 1, wherein the cooling jacket has a communication flow path at a position corresponding to a bottom of the space between the cooling jacket and the molded resin, and the communication flow path communicates a radially inside of the cooling jacket with a radially outside of the cooling jacket.

8. The fluid injection device according to claim 1, further comprising:

an inner jacket that accommodates the injector, wherein the cooling jacket and the inner jacket therebetween form a flow path to cause cooling fluid to flow therethrough.

9. A fluid injection device comprising:

an injector that includes:

a nozzle portion configured to inject fluid;

a coil configured to generate a driving force to drive the nozzle portion to open and close the nozzle portion; and a molded resin that seals the coil;

a cooling jacket that has a flow path configured to cause cooling fluid to flow therethrough, that houses the injector, and that has an opening in an end opposite to the nozzle portion; and a sealing material that is filled in a space between the cooling jacket and the molded resin, wherein the sealing material is formed of a resin material, and the resin material has a thermosetting property and flexibility.

* * * * *